US006595301B1

(12) United States Patent
Diamond et al.

(10) Patent No.: US 6,595,301 B1
(45) Date of Patent: Jul. 22, 2003

(54) SINGLE-BLADE UNDERREAMER

(75) Inventors: Lawrence W. Diamond, Rockwall, TX (US); Joseph A. Zupanick, Pineville, WV (US); Harold E. Payne, Spring, TX (US)

(73) Assignee: CDX Gas, LLC, Dallas, TX (US)

( * ) Notice: Subject to any disclaimer, the term of this patent is extended or adjusted under 35 U.S.C. 154(b) by 35 days.

(21) Appl. No.: 09/932,482

(22) Filed: Aug. 17, 2001

(51) Int. Cl.[7] ..... E21B 10/34
(52) U.S. Cl. ..... 175/57; 175/269; 175/292
(58) Field of Search ..... 175/269, 284, 175/285, 288, 292, 57

(56) References Cited

U.S. PATENT DOCUMENTS

| | | | | |
|---|---|---|---|---|
| 54,144 | A | 4/1866 | Hamar | 175/263 |
| 274,740 | A | 3/1883 | Douglass | |
| 639,036 | A | 12/1899 | Heald | 175/263 |
| 1,189,560 | A | 7/1916 | Gondos | 175/265 |
| 1,285,347 | A | 11/1918 | Otto | 175/263 |
| 1,317,192 | A | 9/1919 | Jones | |
| 1,467,480 | A | 9/1923 | Hogue | 175/263 |
| 1,485,615 | A | 3/1924 | Jones | 175/263 |
| 1,498,463 | A | 6/1924 | McCloskey et al. | |
| 1,674,392 | A | 6/1928 | Flansburg | |
| 1,970,063 | A | 8/1934 | Steinman | 255/74 |
| 2,018,285 | A | 10/1935 | Schweitzer et al. | 166/21 |
| 2,031,353 | A | 2/1936 | Woodruff | 255/76 |
| 2,069,482 | A | 2/1937 | Seay | 255/76 |
| 2,150,228 | A | 3/1939 | Lamb | 166/10 |
| 2,169,502 | A | 8/1939 | Santiago | 255/76 |
| 2,169,718 | A | 8/1939 | Böll et al. | 255/24 |
| 2,450,223 | A | 9/1948 | Barbour | 255/76 |
| 2,490,350 | A | 12/1949 | Grable | 166/4 |
| 2,679,903 | A | 6/1954 | McGowen, Jr. et al. | 166/1 |
| 2,847,189 | A | 8/1958 | Shook | 255/76 |
| 3,379,266 | A | 4/1968 | Fletcher | 175/285 |
| 3,397,750 | A | 8/1968 | Wicklund | 175/18 |
| 3,443,648 | A | 5/1969 | Howard | 175/103 |
| 3,528,516 | A | 9/1970 | Brown | 175/267 |
| 3,684,041 | A | 8/1972 | Kammerer, Jr. et al. | 175/267 |

(List continued on next page.)

OTHER PUBLICATIONS

Pend Pat App, Monty H. Rial et al., "*Pantograph Underreamer*," SN 09/929,551 (067083.0126), Filed Aug. 13, 2001.

Pend Pat App, Monty H. Rial et al., "*Pantograph Underreamer*," SN 09/929,175 (067083.0142), Filed Aug. 13, 2001.

Pend Pat App, Monty H. Rial et al., "*Pantograph Underreamer*," SN 09/929,568 (067083.0145), Filed Aug. 13, 2001.

Pend Pat App, Lawrence W. Diamond et al., "*Multi–Blade-Underreamer*," SN 09/932,487 (067083.0136), Filed Aug. 17, 2001.

Pend Pat App, Monty H. Rial et al., "*Pantograph Underreamer*," SN 10/079,444 (067083.0143), Filed Feb. 19, 2002.

*Primary Examiner*—William Neuder
(74) *Attorney, Agent, or Firm*—Baker Botts L.L.P.

(57) ABSTRACT

A single-blade underreamer for forming a cavity within a well bore includes a housing rotatably disposed within the well bore, and a stabilizer coupled to the housing. The stabilizer is operable to stabilize the housing within the well bore during formation of the cavity. The underreamer also includes a single cutter pivotally coupled to the housing, and a piston slidably disposed within the housing and adapted to engage the cutter. A downwardly disposed force applied to the piston is operable slide the piston relative to the housing to correspondingly extend the cutter outwardly relative to the housing from a retracted position to form the cavity during rotation of the housing.

35 Claims, 6 Drawing Sheets

U.S. PATENT DOCUMENTS

| | | | | | |
|---|---|---|---|---|---|
| 3,757,876 | A | | 9/1973 | Pereau | 175/267 |
| 3,757,877 | A | | 9/1973 | Leathers | 175/269 |
| 4,073,351 | A | | 2/1978 | Baum | 175/14 |
| 4,169,510 | A | | 10/1979 | Meigs | 175/65 |
| 4,189,184 | A | | 2/1980 | Green | 299/8 |
| 4,278,137 | A | | 7/1981 | Van Eek | 175/267 |
| 4,323,129 | A | | 4/1982 | Cordes | 175/285 |
| 4,366,988 | A | | 1/1983 | Bodine | 299/14 |
| 4,396,076 | A | | 8/1983 | Inoue | 175/265 |
| 4,401,171 | A | | 8/1983 | Fuchs | 175/267 |
| 4,407,376 | A | | 10/1983 | Inoue | 175/267 |
| 4,494,616 | A | | 1/1985 | McKee | 175/67 |
| 4,558,744 | A | | 12/1985 | Gibb | 166/335 |
| 4,565,252 | A | | 1/1986 | Campbell et al. | 175/269 |
| 4,618,009 | A | | 10/1986 | Carter et al. | 175/267 |
| 4,674,579 | A | | 6/1987 | Geller et al. | 175/45 |
| 4,715,440 | A | | 12/1987 | Boxell et al. | 166/100 |
| 4,830,105 | A | | 5/1989 | Petermann | 166/241 |
| 5,036,921 | A | | 8/1991 | Pittard et al. | 166/298 |
| 5,135,058 | A | | 8/1992 | Millgard et al. | 175/71 |
| 5,148,875 | A | | 9/1992 | Karlsson et al. | 175/62 |
| 5,201,817 | A | | 4/1993 | Hailey | 175/269 |
| 5,242,017 | A | | 9/1993 | Hailey | 166/55.8 |
| 5,255,741 | A | | 10/1993 | Alexander | 166/278 |
| 5,271,472 | A | | 12/1993 | Leturno | 175/107 |
| 5,363,927 | A | | 11/1994 | Frank | 175/67 |
| 5,385,205 | A | | 1/1995 | Hailey | 166/55.8 |
| 5,402,856 | A | * | 4/1995 | Warren et al. | 175/57 |
| 5,494,121 | A | | 2/1996 | Nackerud | 175/263 |
| 5,499,687 | A | | 3/1996 | Lee | 175/317 |
| 5,722,489 | A | * | 3/1998 | Lambe et al. | 166/269 |
| 5,853,054 | A | | 12/1998 | McGarian et al. | 175/267 |
| 6,070,677 | A | | 6/2000 | Johnston, Jr. | 175/57 |
| 6,227,312 | B1 | | 5/2001 | Eppink et al. | 175/57 |
| 6,378,626 | B1 | * | 4/2002 | Wallace | 175/19 |

* cited by examiner

SINGLE-BLADE UNDERREAMER

RELATED APPLICATIONS

This application is related to application Ser. No. 09/932,487, entitled "Multi-Blade Underreamer," filed on Aug. 17, 2001.

TECHNICAL FIELD OF THE INVENTION

This invention relates in general to the field of subterranean exploration and, more particularly, to a single-blade underreamer.

BACKGROUND OF THE INVENTION

Underreamers are generally used to form an enlarged cavity in a well bore extending through a subterranean formation. The cavity may then be used to collect resources for transport to the surface, as a sump for the collection of well bore formation cuttings and the like, or for other suitable subterranean exploration and resource production operations. Additionally, the cavity may be used in well bore drilling operations to provide an enlarged target for constructing multiple intersecting well bores.

One example of an underreamer includes a plurality of cutting blades pivotally coupled to a lower end of a drill pipe. Centrifugal forces caused by rotation of the drill pipe extends the cutting blades outwardly and diametrically opposed to each other. As the cutting blades extend outwardly, the centrifugal forces cause the cutting blades to contact the surrounding formation and cut through the formation. The drill pipe may be rotated until the cutting blades are disposed in a position substantially perpendicular to the drill pipe, at which time the drill pipe may be raised and/or lowered within the formation to form a cylindrical cavity within the formation.

Conventional underreamers, however, suffer several disadvantages. For example, the underreamer described above generally requires high rotational speeds to produce an adequate level of centrifugal force to cause the cutting blades to cut into the formation. An equipment failure occurring during high speed rotation of the above-described underreamer may cause serious harm to operators of the underreamer as well as damage and/or destruction of additional drilling equipment.

Additionally, density variations in the subsurface formation may cause each of the cutting blades to extend outwardly at different rates and/or different positions relative to the drill pipe. The varied positions of the cutting blades relative to the drill pipe may cause an out-of-balance condition of the underreamer, thereby creating undesired vibration and rotational characteristics during cavity formation, as well as an increased likelihood of equipment failure.

SUMMARY OF THE INVENTION

Accordingly, a need has arisen for an improved underreamer that provides increased control of subterranean cavity formation. The present invention provides a single-blade underreamer that addresses shortcomings of prior underreamers.

According to one embodiment of the present invention, a single-blade underreamer for forming a cavity within a well bore includes a housing rotatably disposed within the well bore, and a stabilizer coupled to the housing. The stabilizer is operable to stabilize the housing within the well bore during formation of the cavity. The underreamer also includes a single cutter pivotally coupled to the housing, and a piston slidably disposed within the housing and adapted to engage the cutter. A downwardly disposed force applied to the piston is operable to slide the piston relative to the housing and correspondingly extend the cutter outwardly relative to the housing from a retracted position to form the cavity during rotation of the housing.

According to another embodiment of the present invention, a method for forming a cavity within a well bore includes providing a single-blade underreamer within a well bore and applying a downwardly directed force to a piston of the underreamer. The piston is slidably disposed within a housing of the underreamer and is coupled to the cutter. The method also includes extending the cutter outwardly from a retracted position relative to the housing in response to movement of the piston relative to the housing from the applied force. The method further includes rotating the underreamer within the well bore and stabilizing the housing within the well bore during rotation of the underreamer.

The invention provides several technical advantages. For example, according to one embodiment of the present invention, a downwardly directed force is applied to a piston of the underreamer to cause outwardly directed movement of a cutting blade into a subterranean formation. The downwardly directed force applied to the piston may be varied to produce corresponding varying pressures on the formation by the cutting blade. Thus, the present invention may be used to accommodate a variety of formation densities and compositions. Additionally, decreased rotational speeds of the underreamer may be used to form the cavity, thereby substantially reducing or eliminating hazards associated with high speed rotating mechanisms.

Another technical advantage of the present invention includes substantially reducing or eliminating out-of-balance conditions resulting from rotation of the underreamer within a well bore. For example, according to one embodiment of the present invention, a single cutter is used to form the cavity within the formation, and a stabilizer is provided to substantially maintain the underreamer concentrically disposed within the well bore during cavity formation. Thus, out-of-balance conditions caused by varying positions of multiple cutting blades is substantially reduced or eliminated.

Other technical advantages will be readily apparent to one skilled in the art from the following figures, descriptions, and claims.

BRIEF DESCRIPTION OF THE DRAWINGS

For a more complete understanding of the present invention and the advantages thereof, reference is now made to the following descriptions taken in connection with the accompanying drawings in which.

DETAILED DESCRIPTION OF THE DRAWINGS

Figure 1:
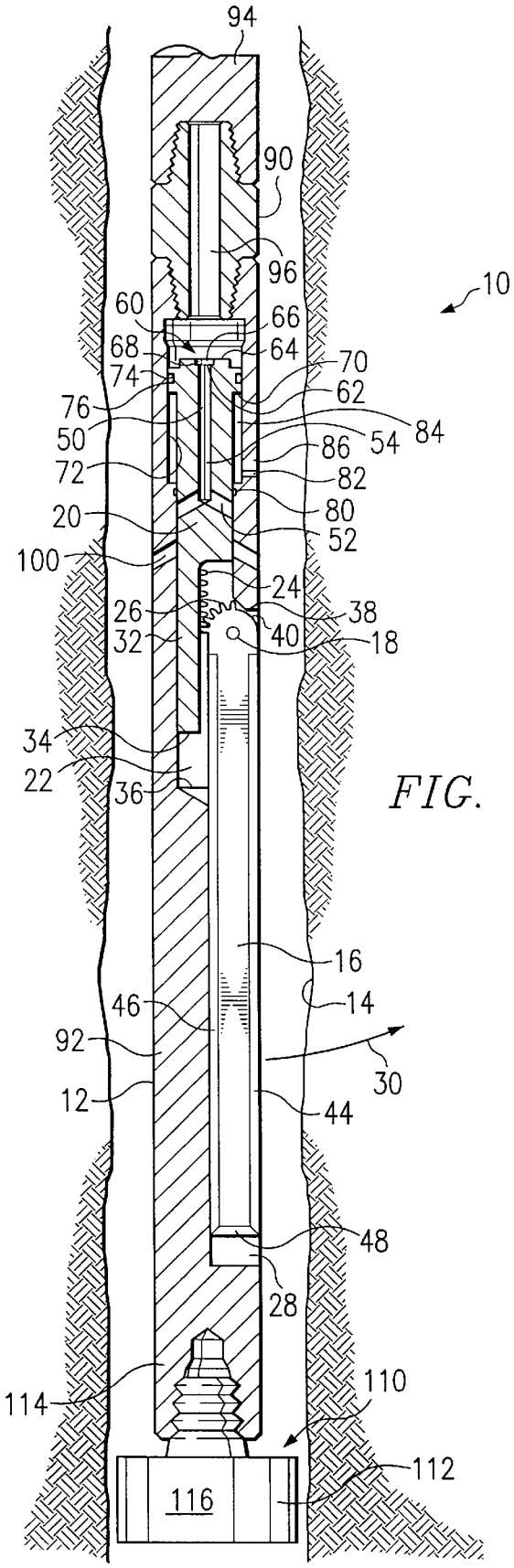
FIG. 1 is diagram illustrating a single-blade underreamer in accordance with an embodiment of the present invention.

FIG. 1 is a diagram illustrating a single-blade underreamer 10 in accordance with an embodiment of the present invention. The underreamer 10 includes a housing 12 illustrated as being substantially vertically disposed within a well bore 14. However, it should be understood that the underreamer 10 may also be used in non-vertical cavity forming operations. The underreamer 10 also includes a single cutting blade 16 pivotally coupled to the housing 12. In this embodiment, the cutting blade 16 is pivotally coupled to the housing via a pin 18; however, other suitable methods may be used to provide pivotal or rotational movement of the cutting blade 16 relative to the housing 12.

The underreamer 10 also includes a piston 20 slidably disposed within an internal cavity 22 of the housing 12. The piston 20 includes an integrally formed rack 24 adapted to engage a corresponding integrally formed pinion 26 of the cutting blade 16. In FIG. 1, the cutting blade 16 is illustrated in a retracted position relative to the housing 12 and is disposed within a recess 28 of the housing to accommodate downward movement of the underreamer 10 relative to the well bore 14. In response to downward movement of the piston 20 relative to the housing 12, teeth of the rack 24 engage teeth of the pinion 26, thereby causing rotation of the cutting blade 16 about the pin 18 in the direction indicated generally at 30 and extending the cutting blade 16 radially outward relative to the housing 12.

As illustrated in FIG. 1, the piston 20 includes an elongated portion 32 extending downwardly adjacent to the cutting blade 16. The elongated portion 32 may be formed having a length such that a lower end 34 of the portion 32 engages an inwardly facing shoulder 36 of the housing 12 formed within the cavity 22 adjacent to the cutting blade 16 to limit the downward movement of the piston 20 relative to the housing 12. For example, the location of the shoulder 36 and corresponding length of the elongated portion 32 may be constructed such that the lower end 34 engages the shoulder 36 when the cutting blade 16 is disposed in a generally perpendicular or fully extended position relative to the housing 12. The housing 12 may also include a shoulder 38 tangentially disposed relative to an arcuately formed surface 40 of the cutting blade 16 to limit the rotational movement of the cutting blade 16 relative to the housing 12. For example, as the cutting blade 16 rotates in the direction indicated generally at 30, the shoulder 38 may be used to limit rotational movement of the cutting blade 16 to a substantially perpendicular position relative to the housing 12. However, it should be understood that other suitable methods may be used to limit the rotational movement and corresponding extended position of the cutting blade 16 relative to the housing 12.

In the embodiment illustrated in FIG. 1, the cutting blade 16 comprises upwardly and downwardly disposed cutting surfaces 44 and 46, respectively, and an outwardly disposed cutting surface 48. The cutting surfaces 44, 46 and 48 may be dressed with a variety of different cutting materials, including, but not limited to, polycrystalline diamonds, tungsten carbide inserts, crushed tungsten carbide, hard facing with tube borium, or other suitable cutting structures to accommodate a particular subsurface formation. Additionally, various cutting surface 44, 46 and 48 configurations may be machined or formed on the cutting blade 16 to enhance the cutting characteristics of the cutting blade 16.

The piston 20 also includes an internal fluid passage 50 and outlets 52 disposed in communication with the passage 50 proximate to a lower end 54 of the passage 50. A deformable member 60 is disposed over an inlet 62 of the passage 50 proximate to an upper end 64 of the piston 20. In this embodiment, the deformable member 60 includes a rupture disc 66 disposed within an inwardly facing annular shoulder 68 of the inlet 62.

The piston 20 also includes an outwardly facing annular shoulder 70 disposed within an inwardly facing annular groove 72 of the housing 12. A seal 74 is disposed within an outwardly facing annular groove 76 of the piston 20. A seal 78 is also disposed within an inwardly facing annular groove 80 of the housing 12. Seals 74 and 78 may include elastomer O-ring type seals for restricting fluid movement to predetermined locations of the underreamer 10. However, it should be understood that other suitable types of sealing members may also be used. As illustrated in FIG. 1, the housing 12 also includes a bleed port 82 disposed in communication with an annulus 84 formed between the groove 72 and an outer wall 86 of the housing 12 to accommodate upward and downward movement of the piston 20 relative to the housing 12.

In the embodiment illustrated in FIG. 1, the housing 12 includes an upper portion 90 and a lower portion 92. In this embodiment, the upper portion 90 is threadably coupled to an upper end 94 of the housing 12. However, the upper and lower portions 90 and 92, respectively, may be otherwise formed and coupled together. The upper portion 90 includes an internal passage 96 for providing a pressurized fluid downwardly to the upper end 64 of the piston 20. Thus, in operation, the pressurized fluid disposed within the passage 96 applies a downwardly directed force to the upper end 64 of the piston 20, thereby causing downward movement of the piston 20 relative to the housing 12. The deformable member 60 is constructed having a predetermined deformation pressure, or the pressure at which the deformable member 60 deforms to allow the pressurized fluid to enter the passage 50. For example, the deformation member 60 may be constructed such that deformation occurs at approximately 750 pounds per square inch (psi). Thus, the deformable member substantially prevents the pressurized fluid from entering the passage 50 at fluid pressures below the deformation pressure, thereby maintaining a downwardly directed force applied to the piston 20.

As the piston 20 moves downwardly relative to the housing 12, the rack 24 of the piston 20 engages the pinion 26 of the cutting blade 16, thereby causing rotation of the cutting blade 16 about the pin 18 and corresponding outward radial movement of the cutting blade 16 from a retracted position in the direction indicated generally at 30. The rack 24 and pinion 26 engagement maintains a substantially consistent force applied by the cutting blade 16 to the subsurface formation. Thus, the pressurized fluid provided downwardly within the passage 96 to the piston 20 may be controlled such that the cutting blade 16 provides corresponding levels of pressure to the subsurface formation during cavity formation. A rotational force is applied to the housing 12 by suitable equipment (not explicitly shown) located at the surface or otherwise to circulate the cutting blade 16 about the well bore 14 during cavity formation.

As illustrated in FIG. 1, housing 12 also includes circulation ports 100 disposed at a downwardly angular orientation relative to the housing 12 and well bore 14. In operation, as the piston 20 moves downwardly relative to the housing 12, the outlets 52 of the passage 50 become aligned with the circulation ports 100, thereby providing fluid communication between the passage 50 and the well bore 14 proximate to the cutting blade 16. The circulation ports 100 are disposed at the downwardly disposed angular orientation to direct a fluid toward the cutting blade 16. The circulation ports 100 may be positioned on the housing 12 such that the outlets 52 become aligned with the circulation ports 100 when the cutting blades 16 are fully extended. However, the positional relationship of the circulation ports 100 relative to the outlets 52 may be otherwise constructed to provide the fluid communication path between the passage 50 and the cutting blades 16 at other suitable positions of the cutting blade 16 relative to the housing 12.

Thus, in the embodiment illustrated in FIG. 1, the pressure of the fluid within the passage 96 may be increased to a level exceeding the predetermined deformation pressure associated with the rupture disc 66 such that the rupture disc 66 deforms, thereby providing fluid communication from the passage 96 to the passage 50. Correspondingly, the fluid within the passage 50 is communicated outwardly via the circulation ports 100 to the well bore 14 and cutting blade 16 to facilitate cutting removal and cavity formation. Additionally, the pressure of the fluid within the passage 96 may be varied prior to reaching the deformation pressure to accommodate applying variable pressures on the subsurface formation during cavity formation by the cutting blade 16.

The underreamer 10 also includes a stabilizer 110 for substantially maintaining a concentric position of the housing 12 relative to the well bore 14 during rotation of the housing 12 for cavity formation. In the embodiment illustrated in FIG. 1, the stabilizer 110 includes a tool 112 threadably coupled to a lower end 114 of the housing 12 sized slightly smaller than a size of the well bore 14 to accommodate downward travel of the underreamer 10 within the well bore 14 while minimizing lateral movement of the housing 12 during cavity formation. For example, the tool 112 includes a substantially cylindrically formed body portion 116 sized slightly smaller than the lateral width or size of the well bore 14 to minimize lateral movement of the housing 12 within the well bore 14. However, it should be understood that other suitable methods and devices may also be used to stabilize the housing within the well bore 14 to limit lateral movement of the housing 12.

Figure 3:
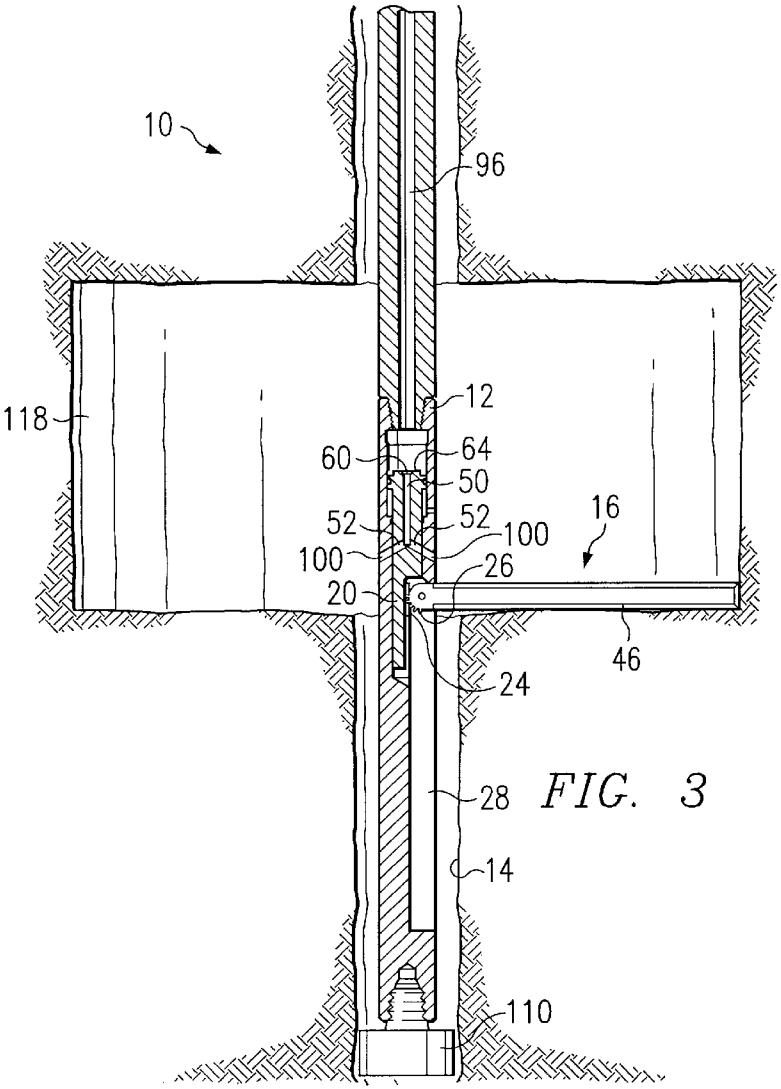
FIG. 3 is a diagram illustrating the single-blade underreamer illustrated in FIGS. 1 and 2 after vertical movement of the underreamer in accordance with an embodiment of the present invention.
Figure 2:
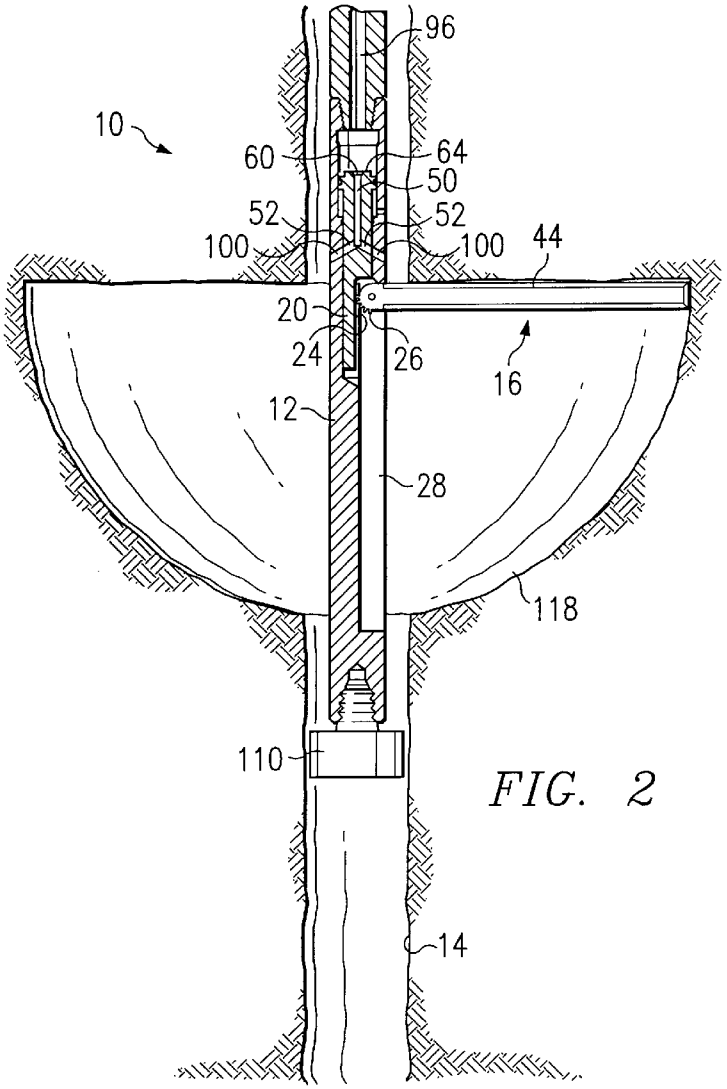
FIG. 2 is a diagram illustrating the single-blade underreamer illustrated in FIG. 1 in an extended position in accordance with an embodiment of the present invention.

FIGS. 2 and 3 are diagrams illustrating the underreamer 10 illustrated in FIG. 1 in accordance with an embodiment of the present invention having the cutting blade 16 disposed in an extended position relative to the housing 12. Referring to FIG. 2, the piston 20 is illustrated in a downwardly disposed position relative to the housing 12 such that the outlets 52 are aligned with the circulation ports 100. As described above, in this embodiment, the outlets 52 and circulation ports 100 are positioned to provide fluid communication between the passage 50 and the cutting blade 16 when the cutting blade 16 is disposed in a substantially perpendicular orientation relative to the housing 12. As described above, the pressure of the fluid disposed downwardly within the passage 96 may be increased or decreased to provide varying levels of pressure applied by the cutting blade 16 to the subsurface formation. Additionally, the pressure of the fluid disposed within the passage 96 may be increased to a level above the deformation pressure associated with the rupture disc 66, thereby deforming or rupturing the disc 66 and allowing the fluid to travel downwardly within the passage 50 and outwardly through the outlets 52 and circulation ports 100.

Referring to FIG. 3, the underreamer 10 may be translated upwardly and/or downwardly within the well bore 14 to form an enlarged diameter cavity 118 having a generally cylindrical configuration in the subsurface formation. For example, as illustrated in FIG. 3, after the cutting blade 16 has been extended to a predetermined position or orientation relative to the housing 12, the underreamer 10 may be translated downwardly within the well bore 14 such that the cutting surface 46 is primarily in contact with the formation for forming the cylindrical cavity 118. However, it should be understood that the cavity 118 may also have a non-cylindrical configuration. For example, after forming the cavity 118 as illustrated in FIG. 2, the underreamer 10 may be translated upwardly relative to the well bore 14 such that the cutting surface 44 of the cutting blade 16 remains in primary contact with the formation, thereby forming a cavity 118 having a cylindrical portion and a hemispherical portion.

Thus, the present invention provides greater control of the cavity formation process by providing for varying pressures to be applied by the cutting blade 16 to the subsurface formation by varying the fluid pressure provided downwardly within the passage 96. Therefore, the underreamer 10 may be used to form cavities within a variety of subsurface formations having a variety of densities by providing varying cutting pressures applied by cutting blade 16. Additionally, the stabilizer 110 provides substantially concentric placement of the underreamer 10 within the well bore 14 during rotation of the underreamer 10, thereby substantially reducing or eliminating lateral movement of the underreamer 10 within the well bore 14. Additionally, because the pressure applied by the cutting blade 16 is regulated via the pressurized fluid provided downwardly within the passage 96, the required rotational velocities required to form the cavity are substantially reduced.

Figure 4:
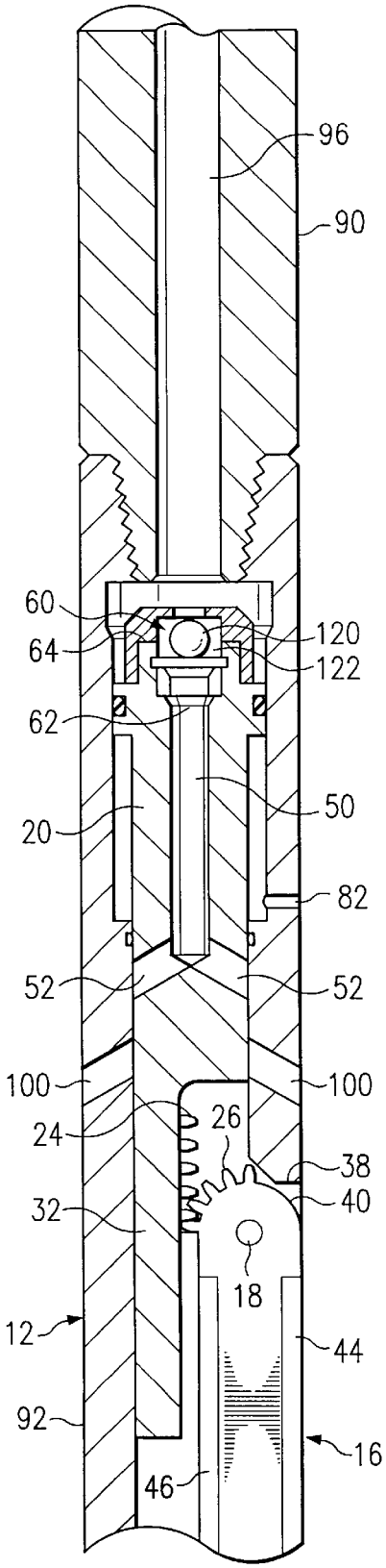
FIG. 4 is a diagram illustrating a single-blade underreamer in accordance with another embodiment of the present invention.
Figure 5:
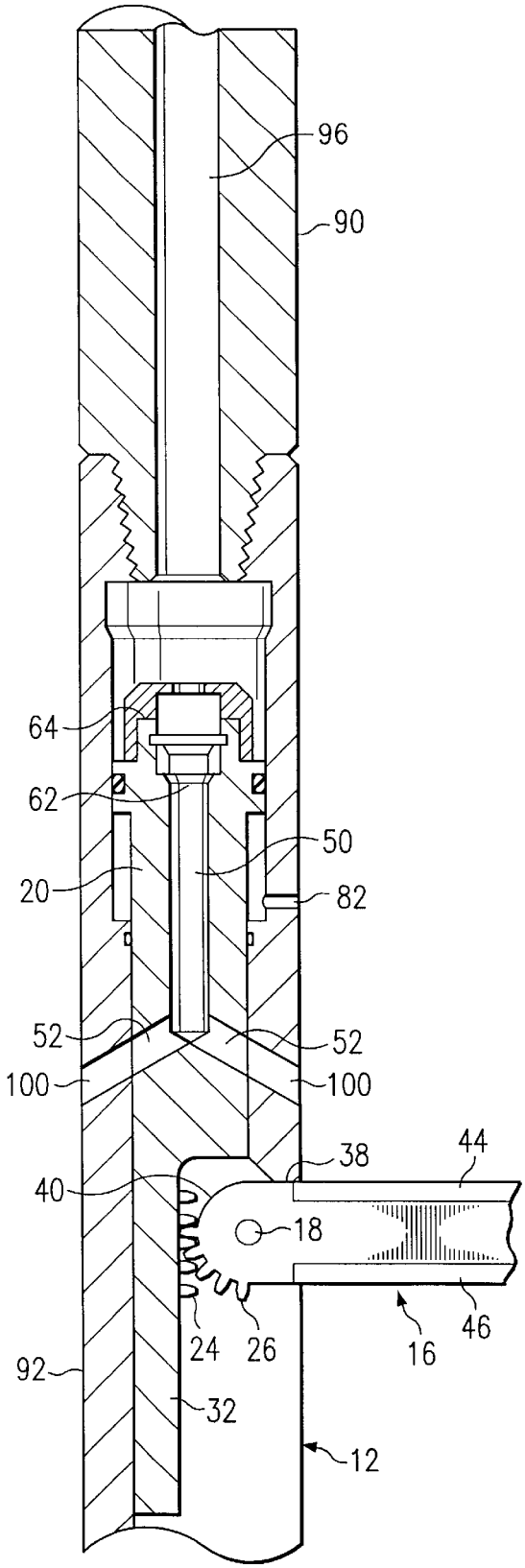
FIG. 5 is a diagram illustrating the single-blade underreamer illustrated in FIG. 4 in an extended position in accordance with an embodiment of the present invention.

FIGS. 4 and 5 are diagrams illustrating the underreamer 10 in accordance with another embodiment of the present invention. In this embodiment, the deformable member 60 comprises an elastomer object 120 disposed over the inlet 62. For example, referring to FIG. 4, the elastomer object 120 may be disposed within a seating area 122 disposed proximate to the inlet 62 to substantially prevent the pressurized fluid provided downwardly within the passage 96 from entering the passage 50. The elastomer object 120 may comprise an elastomeric ball or other suitable flexible object that may be deformed at a predetermined deformation pressure.

Thus, in operation, pressurized fluid is provided downwardly within the passage 96 to the upper end 64 of the piston 20. The elastomer object 120 substantially prevents passage of the pressurized fluid into the passage 50, thereby resulting in a downwardly directed force applied to the upper end 64 of the piston 20. As the pressure of the fluid is increased, the piston 20 moves downwardly relative to the housing 12, thereby causing outwardly movement of the cutting blade 16 relative to the housing 12. As described above, engagement of the rack 24 with the pinion 26 provides a substantially consistent force during the formation of the cavity.

Referring to FIG. 5, as the cutting blade 16 becomes fully extended relative to the housing 12, which may be indicated by a reduction in the rotary torque applied to the housing 12, the pressure of the fluid provided within the passage 96 may be increased to a pressure greater than the deformation pressure associated with the elastomer object 120. As the elastomer object 120 deforms, the pressure of the fluid within the passage 96 will cause the elastomer object 120 to pass through the passage 50 and outwardly through one of the circulation ports 100, thereby providing fluid communication between the passage 50 and the cutting blade 16. For example, the fluid provided downwardly within the passage 96 may be provided at a pressure of approximately 500 psi during cavity formation. The pressure of the fluid within the passage 96 may then be increased to the predetermined deformation pressure, such as 750 psi, for deforming the elastomer object 120 to provide fluid communication between the passage 50 and the cutting blade 16.

Figure 6:
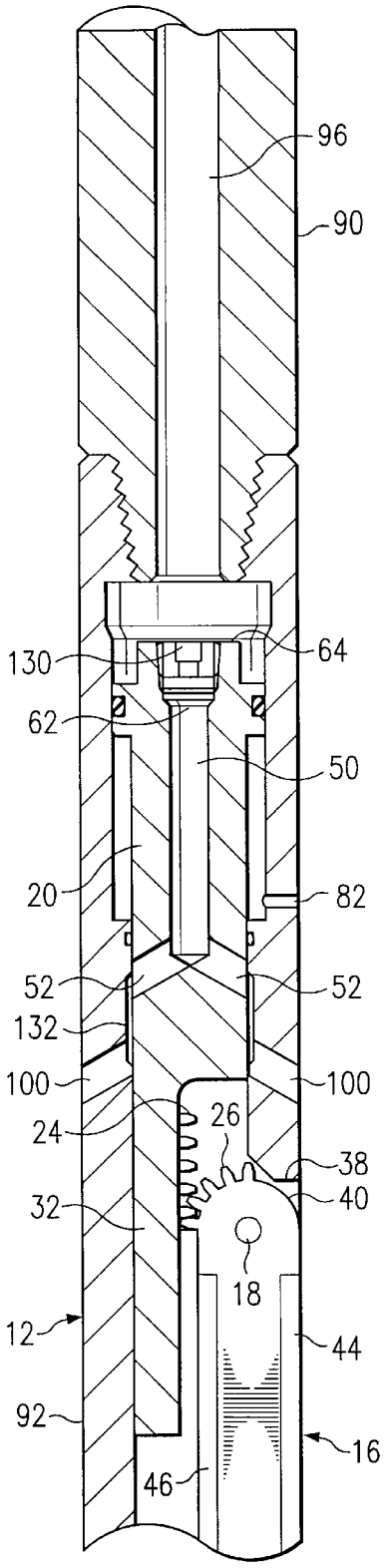
FIG. 6 is a diagram illustrating a single-blade underreamer in accordance with another embodiment of the present invention.
Figure 7:
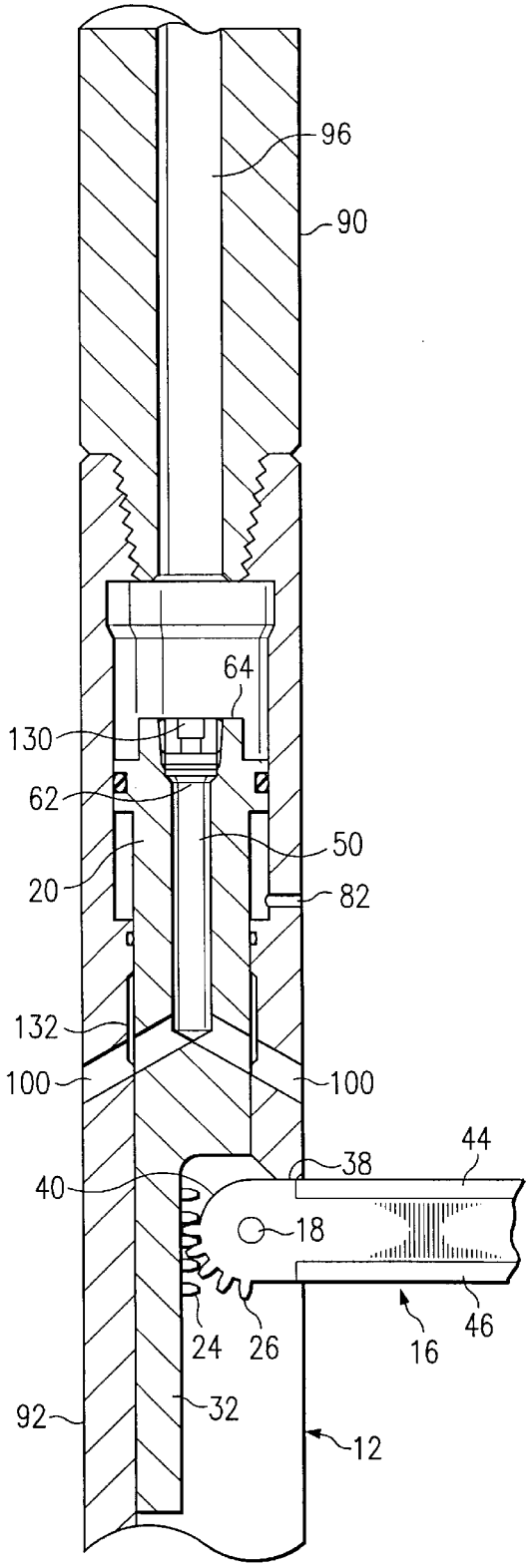
FIG. 7 is a diagram illustrating the single-blade underreamer illustrated in FIG. 6 in an extended position in accordance with an embodiment of the present invention.

FIGS. 6 and 7 are diagrams illustrating the underreamer 10 in accordance with another embodiment of the present invention. In this embodiment, a nozzle 130 is disposed proximate to the inlet 62 to restrict a flow of the pressurized fluid provided downwardly within the passage 96 to the passage 50. Additionally, the housing 12 includes an inwardly facing annular groove 132 to provide fluid communication between the outlets 52 and the circulation ports 100 throughout the travel of the piston 20 relative to the housing 12.

In operation, the pressurized fluid provided downwardly within the passage 96 to the upper end 64 of the piston 20 provides a differential pressure across the upper end 64 of the piston 20, thereby causing downward movement of the piston 20 relative to the housing 12. As the piston 20 moves downwardly relative to the housing 12, the cutting blade 16 is rotated outwardly from a retracted position into the subsurface formation to form the cavity 118. The rack 24 and pinion 26 interface provides a substantially consistent cutting force applied by the cutting blade 16 to the subsurface formation during cavity 118 formation. Additionally, the nozzle 130 provides fluid communication between the passage 96 and the cutting blade 16 via the passage 50, outlets 52, groove 132, and circulation ports 100.

Referring to FIG. 7, as the cutting blade 16 reaches a fully extended position relative to the housing 12, which may be indicated by a reduction in the rotary torque of the underreamer 10, the pressure of the fluid provided downwardly within the passage 96 may be increased, thereby providing additional fluid flow through the passage 50, outlets 52, groove 132, and circulation ports 100 to provide additional cavity 118 and well bore 14 cleaning.

Figure 8:
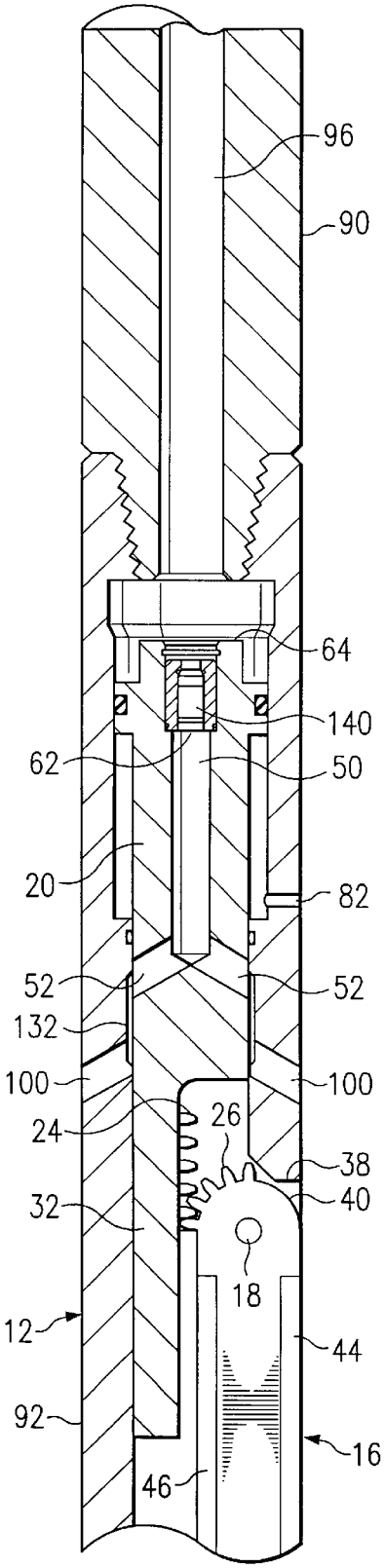
FIG. 8 is a diagram illustrating a single-blade underreamer in accordance with another embodiment of the present invention.
Figure 9:
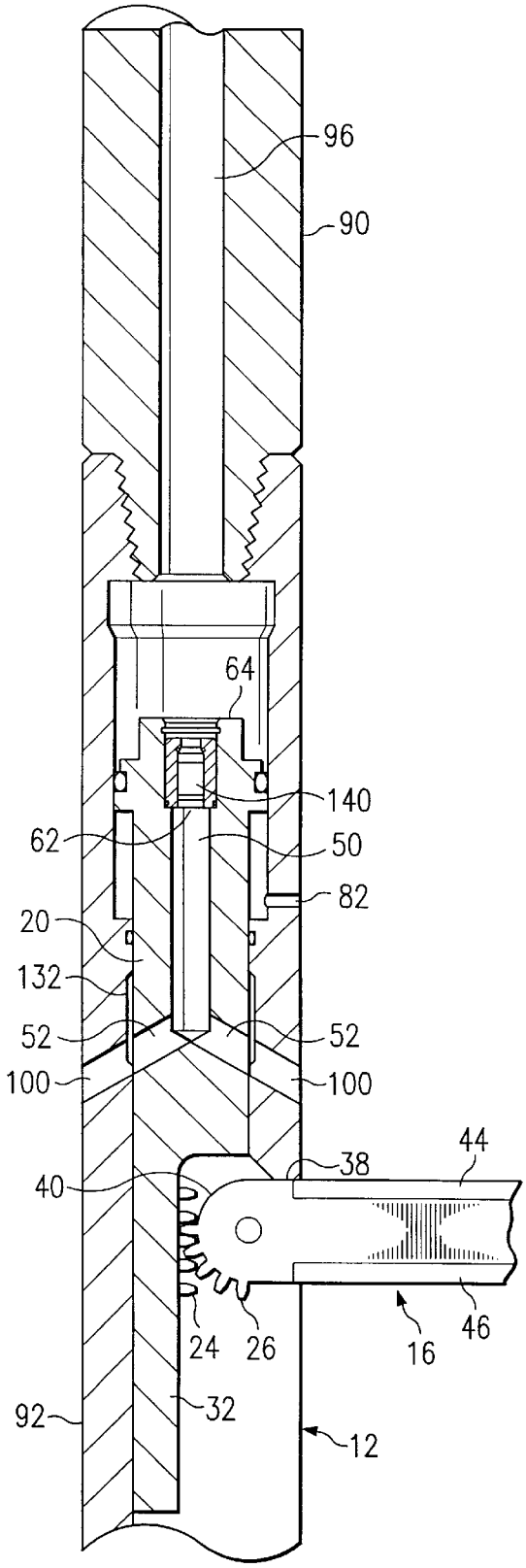
FIG. 9 is a diagram illustrating the single-blade underreamer illustrated in FIG. 8 in an extended position in accordance with an embodiment of the present invention.

FIGS. 8 and 9 are diagrams illustrating the underreamer 10 in accordance with another embodiment of the present invention. In this embodiment, a relief valve 140 is disposed proximate to the inlet 62 to substantially prevent fluid flow into the passage 50 until a predetermined relief pressure of the fluid provided within the passage 96 is reached. Thus, the fluid within the passage 96 provides a downwardly directed force applied to the upper end 64 of the piston 20, thereby causing downward movement of the piston 20 relative to the housing 12.

Referring to FIG. 9, as the piston 20 moves downwardly relative to the housing 12, the cutting blade 16 extends outwardly from the retracted position and into the subsurface formation. Additionally, as the pressure of the fluid within the passage 96 is increased to a pressure greater than the predetermined relief pressure, fluid communication between the passage 96 and the passage 50 results, thereby providing fluid to the cutting blade 16 via the passage 50, outlets 52, groove 132, and circulation ports 100. The rack 24 and pinion 26 engagement provides a substantially consistent cutting force applied by the cutting blade 16 to the subsurface formation during cavity 118 formation. Additionally, the pressure of the fluid within the passage 96 may also be reduced to below the predetermined relief pressure, thereby allowing the relief valve 140 to close to maintain a substantially constant pressure on the upper end 64 of the piston 20.

FIGS. 10A through 10D are diagrams illustrating the underreamer 10 in accordance with alternate embodiments of the present invention. The underreamer 10 illustrated in each of the FIGS. 10A through 10D includes an interchangeable portion 150 coupled to the upper end 64 of the piston 20. The interchangeable portion 150 may be removed and replaced with a variety of functional alternatives to provide operational flexibility of the underreamer 10.

The interchangeable portion 150 in each of the embodiments illustrated in FIGS. 10A through 10D includes an internal passage 152 disposed in communication with the passage 50 of the piston 20. The interchangeable portion 150 also includes externally formed threads 154 adapted to engage corresponding internally formed threads 156 of the piston 20 to removable couple the interchangeable portion 150 to the piston 20. However, the interchangeable portion 150 may be otherwise removably coupled to the upper end 64 of the piston 20.

The piston 20 may also include a plurality of inwardly extending openings 158 adapted for receiving set screws or other devices (not explicitly shown) for securing the interchangeable portion 150 relative to the piston 20 and substantially prevent rotation of the interchangeable portion 150 relative to the piston 20 during operational use. The interchangeable portion 150 may also include an outwardly facing annular recess 160 adapted for receiving a sealing member 162 to substantially prevent undesired fluid movement between the interchangeable portion 150 and the piston 20.

Figure 10A:
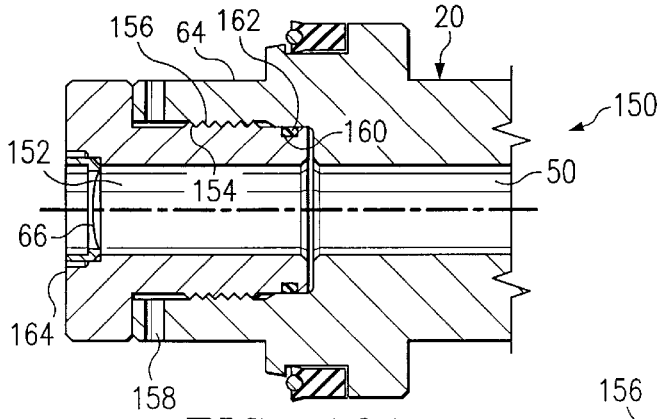
FIGS. 10A through 10D are diagrams illustrating the single-blade underreamer an accordance with another embodiment of the present invention.

Referring to FIG. 10A, the interchangeable portion 150 in this embodiment includes the rupture disc 66 disposed proximate to an upper end 164 of the interchangeable portion 150 and over the passage 152. Thus, the movement of the piston 20 and actuation of the cutting blade 16 of the underreamer 10 in this embodiment operates as described above in connection with FIGS. 1 through 3. Thus, after deformation of the rupture disc 66, a fluid passes into the passage 50 of the piston 20 via the passage 152 of the interchangeable portion 150.

Figure 10B:
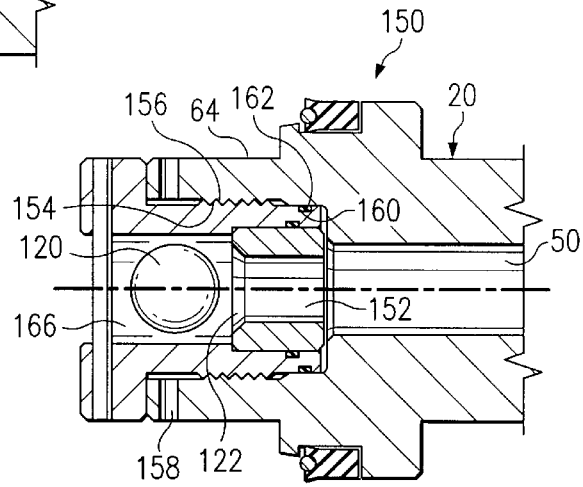

Referring to FIG. 10B, the interchangeable portion 150 in this embodiment includes the elastomer object 120 and the seating area 122 disposed over the passage 152. For example, the elastomer object 120 is disposed within an internal cavity 166 of the portion 150 such that a downward force applied to the elastomer object 120 seats the elastomer object 120 against the seating area 122. Upon an increase of the downward force and deformation of the elastomer object 120, the elastomer object 120 passes through the passage 152 and into the passage 50, thereby providing fluid communication between the passages 152 and 50. Thus, in this embodiment, movement of the piston 20 and actuation of the cutting blade 16 in this embodiment operates as described above in connection with FIGS. 4 and 5.

Figure 10C:
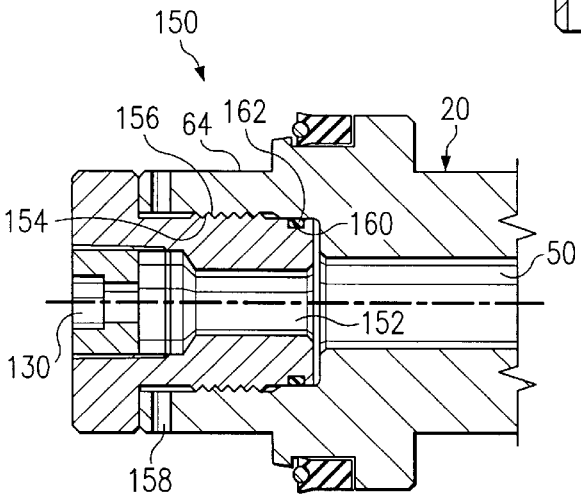

Referring to FIG. 10C, the interchangeable portion 150 in this embodiment includes the nozzle 130 disposed proximate to and in communication with the passage 152. The nozzle 130 restricts a flow of a downwardly disposed fluid, thereby providing downward movement of the piston 20 while routing a portion of the fluid into the passage 50 via the passage 152. Thus, movement of the piston 20 and actuation of the cutting blade 16 in this embodiment operates as described above in connection with FIGS. 6 and 7.

Figure 10D:
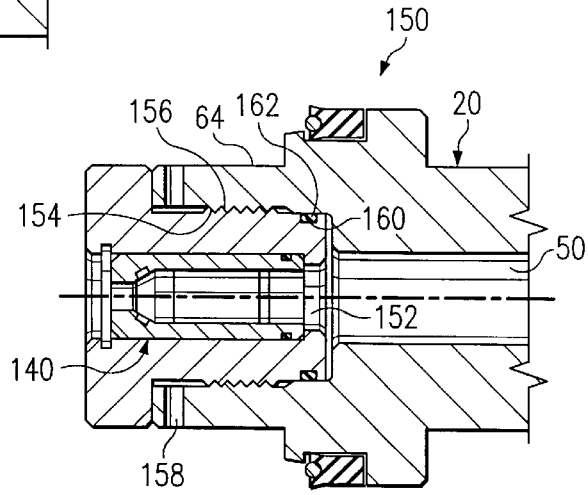

Referring to FIG. 10D, the interchangeable portion 150 in this embodiment includes the relief valve 140 disposed proximate to and in communication with the passage 152. As a fluid is provided downwardly in contact with the interchangeable portion 150, the relief valve 140 restricts a flow of the fluid into the passage 152 until a predetermined pressure is obtained, thereby resulting in downward movement of the piston 20. After the predetermined fluid pressure is obtained, the relief valve 140 provides communication of the fluid into the passage 50 via the passage 152. Thus, the movement of the piston 20 and actuation of the cutting blade 16 in this embodiment operates as described above in connection with FIGS. 8 and 9.

Thus, the interchangeable portion 150 may be adapted to provide a variety of operating characteristics adapted to the drilling requirements of a particular well bore. The interchangeable portion 150 may be readily replaced with the desired configuration to provide piston 20 movement and fluid flow to the cutting blade 16 as described above. Therefore, the present invention provides greater flexibility than prior underreamers.

Although the present invention has been described in detail, various changes and modifications may be suggested to one skilled in the art. It is intended that the present invention encompass such changes and modifications as falling within the scope of the appended claims.

What is claimed is:

1. A single-blade underreamer for forming a cavity within a well bore, comprising:

a housing adapted to be rotatably disposed within the well bore;

a stabilizer coupled to the housing and operable to stabilize the housing within the well bore during formation of the cavity, the diameter of the stabilizer greater than the diameter of the housing;

a single cutter pivotally coupled to the housing;

a piston slidably disposed within the housing and adapted to engage the cutter, wherein a downwardly disposed force applied to the piston is operable to slide the piston relative to the housing to correspondingly extend the cutter outwardly relative to the housing from a retracted position to form the cavity during rotation of the housing relative to the well bore; and wherein the downwardly disposed force is operable to move the piston within the housing to align a fluid passage disposed within the piston with a circulation port disposed within a wall of the housing.

2. The underreamer of claim 1, wherein the downwardly disposed force comprises a pressurized fluid.

3. The underreamer of claim 1, wherein the fluid passage is adapted to be disposed in communication with the circulation port to direct a fluid outwardly from the circulation port to the cutter.

4. The underreamer of claim 3, wherein the fluid passage comprises:

an inlet;

an outlet operable to be disposed in alignment with the circulation port; and a deformable member disposed proximate the inlet, and wherein an increase in the downwardly disposed force deforms the member such that the fluid travels through the fluid passage and outwardly through the circulation port.

5. The underreamer of claim 4, wherein the deformable member comprises an elastomer object.

6. The underreamer of claim 5, wherein the increase in the downwardly disposed force transfers the elastomer object downwardly within the fluid passage and beyond the circulation port.

7. The underreamer of claim 3, wherein the circulation port is disposed at a downwardly disposed angle relative to the well bore.

8. The underreamer of claim 3, wherein the deformable member comprises a disc, and wherein the increase in the downwardly disposed force ruptures the disc to provide fluid communication between the inlet and the circulation port.

9. The underreamer of claim 3, further comprising a nozzle disposed proximate an inlet, the nozzle operable to communicate a predetermined amount of fluid through the passage to the cutter.

10. The underreamer of claim 3, further comprising a relief valve disposed proximate an inlet, the relief valve operable to communicate a predetermined amount of fluid through the passage in response to a predetermined level of the downwardly disposed force.

11. The underreamer of claim 1, wherein the cutter comprises a pinion, and wherein the piston comprises a rack operable to engage the pinion to extend and retract the cutter relative to the housing.

12. The underreamer of claim 1, and further comprising a deformable member disposed at an inlet of the fluid passage, and wherein an increase in the downwardly disposed force deforms the member to provide fluid communication between the inlet and the circulation port.

13. The underreamer of claim 1, wherein the stabilizer is operable to maintain a substantially centered position of the housing within the well bore during formation of the cavity.

14. The underreamer of claim 1, wherein the stabilizer comprises a plug coupled to a lower end of the housing, the plug sized to maintain a substantially centered position of the housing within the well bore during formation of the cavity.

15. A method for forming a cavity within a well bore, comprising:

providing a single-blade underreamer within a well bore, the underreamer having a single cutter for forming the cavity;

applying a downwardly directed force to a piston of the underreamer, the piston slidably disposed within a housing of the underreamer and coupled to the cutter, wherein the downwardly disposed force is operable to move the piston within the housing to align a fluid passage disposed within the piston with a circulation port disposed within a wall of the housing;

extending the cutter outwardly from a retracted position relative to the housing in response to movement of the piston relative to the housing from the applied force;

rotating the underreamer within the well bore; and stabilizing the housing within the well bore during rotation of the underreamer, wherein the housing is stabilized with a stabilizer having a greater diameter than the diameter of the housing.

16. The method of claim 15, wherein extending the cutter outwardly comprises engaging a pinion of the cutter with a rack of the pinion.

17. The method of claim 15, wherein stabilizing comprises maintaining the housing in a substantially centered position within the well bore.

18. The method of claim 15, wherein applying a downwardly directed force comprises applying a pressurized fluid down a passage of the underreamer.

19. The method of claim 18, further comprising directing the fluid outwardly from the passage to the cutter.

20. The method of claim 19, wherein directing the fluid comprises:

receiving the fluid at an inlet of the passage of the piston;

increasing the pressure of the fluid within the passage;

deforming a deformable member disposed proximate to the inlet from the increased pressure; and communicating the fluid from the passage to the cutter after deformation of the deformable member.

21. The method of claim 20, wherein deforming the deformable member comprises rupturing a disc disposed over the inlet.

22. The method of claim 20, wherein deforming the deformable member comprises deforming an elastomer object disposed over the inlet.

23. The method of claim 19, wherein directing the fluid comprises:

receiving the fluid at a relief valve, the relief valve disposed at an inlet of the passage of the piston;

increasing the pressure of the fluid within the passage to a predetermined level; and communicating the fluid from the passage to the cutter after reaching the predetermined pressure level.

24. The method of claim 19, wherein directing the fluid comprises:

receiving the fluid at a nozzle, the nozzle disposed at an inlet of the passage of the piston;

increasing the pressure of the fluid within the passage to a predetermined level; and communicating the fluid from the passage to the cutter after reaching the predetermined pressure level.

25. The method of claim 15, wherein applying a downwardly directed force to the piston comprises:

receiving a fluid via a passage of the piston at a nozzle; and restricting a flow of the fluid through the nozzle to form the downwardly directed force on the piston.

26. The method of claim 25, further comprising directing the fluid exiting the nozzle to the cutter.

27. A single-blade underreamer for forming a cavity within a well bore, comprising:

a housing comprising a circulation port;

a piston slidably disposed within the housing, the piston having a passage for receiving a fluid;

a single cutter pivotally coupled to the housing and adapted to engage the piston, the cutter operable to extend outwardly relative to the housing from a retracted position in response to a downwardly disposed force applied to the piston, the downwardly disposed force moving the piston relative to the housing wherein the downwardly disposed force is operable to move the piston within the housing to align the passage with the circulation port; and a stabilizer coupled to the housing and operable to concentrically dispose the housing within the well bore during rotation of the housing relative to the well bore, the diameter of the stabilizer greater than the diameter of the housing.

28. The underreamer of claim 27, wherein the passage is adapted to be disposed in communication with the circulation port to direct a fluid outwardly from the circulation port to the cutter.

29. The underreamer of claim 28, wherein the passage comprises:

an inlet;

an outlet operable to be disposed in alignment with the circulation port; and a deformable member disposed proximate to the inlet, and wherein an increase in the downwardly disposed force deforms the member such that the fluid travels through the passage and outwardly through the circulation port.

30. The underreamer of claim 29, wherein the deformable member comprises an elastomer object, and wherein the increase in the downwardly disposed force transfers the elastomer object downwardly within the passage and beyond the circulation port.

31. The underreamer of claim 28, wherein the circulation port is disposed at a downwardly disposed angle relative to the well bore.

32. The underreamer of claim 28, wherein a deformable member comprises a disc, and wherein the increase in the downwardly disposed force ruptures the disc to provide fluid communication between the inlet and the circulation port.

33. The underreamer of claim 28, further comprising a nozzle disposed proximate the inlet, the nozzle operable to restrict a flow rate of the fluid through the passage to the cutter.

34. The underreamer of claim 33, wherein the restricted flow rate of the nozzle creates the downwardly directed force on the piston.

35. The underreamer of claim 28, further comprising a relief valve disposed proximate an inlet, the relief valve operable to communicate the fluid through the passage in response to a predetermined level of the downwardly disposed force.

* * * * *